US005604935A

United States Patent [19]

Nezer

[11] Patent Number: 5,604,935

[45] Date of Patent: Feb. 25, 1997

[54] COLLAPSIBLE HELMET

[75] Inventor: Shlomo Nezer, Carmiel, Israel

[73] Assignee: Motorika Ltd., Nazeret Elite, Israel

[21] Appl. No.: 372,743

[22] Filed: Jan. 13, 1995

[51] Int. Cl.[6] ..... A42B 3/32

[52] U.S. Cl. ..... 2/410; 2/424

[58] Field of Search ..... 2/410, 411, 417, 2/421, 422, 424, 425, 209.11, 6.6, 6.8, 416, 8, 418, 419, 420, 171.03, 205, 202

[56] References Cited

U.S. PATENT DOCUMENTS

| | | | |
|---|---|---|---|
| 2,277,994 | 3/1942 | Roberts | 2/421 |
| 2,679,046 | 5/1954 | Dye | 2/416 |
| 2,758,306 | 8/1956 | Grancsay et al. | 2/419 |
| 3,026,525 | 3/1962 | Gyorfy | 2/202 |
| 3,451,066 | 6/1969 | Shears et al. | 2/416 |
| 3,514,787 | 6/1970 | Kennedy, Jr. | 2/410 |
| 3,991,422 | 11/1976 | Saotome | 2/410 |
| 4,062,067 | 12/1977 | Franzen | 2/410 |
| 4,291,417 | 9/1981 | Pagano | 2/202 |
| 4,607,397 | 8/1986 | Laxo | 2/410 |
| 4,827,537 | 5/1989 | Villa | 2/410 |
| 4,885,806 | 12/1989 | Heller | 2/424 |

FOREIGN PATENT DOCUMENTS

| | | | |
|---|---|---|---|
| 6192907 | 7/1994 | Japan | 2/410 |
| 2220556 | 1/1990 | United Kingdom | 2/411 |

*Primary Examiner*—Michael A. Neas
*Attorney, Agent, or Firm*—Mark M. Friedman

[57] ABSTRACT

A collapsible helmet including an elliptic headband and an arc-shaped strap hingedly attached to the headband, the strap extending laterally across the crown of a wearer when deployed in its upright operative position so as to define a head protecting shell and lying co-planar with the headband when deployed in its folded inoperative position so as to define a relatively thin compact package. The helmet further includes a pair of arc-shaped ribs hingedly attached to the headband, the pair of ribs extending longitudinally across the crown of a wearer when deployed in their upright operative positions and lying co-planar with the headband when deployed in their folded inoperative positions. The helmet still further includes a face guard hingedly attached to the headband, the face guard extending laterally across the chin of a wearer when deployed in its downward inclined operative position and lying co-planar with the headband when deployed in its folded inoperative position.

17 Claims, 4 Drawing Sheets

COLLAPSIBLE HELMET

FIELD AND BACKGROUND OF THE INVENTION

The present invention relates to helmets in general and in particular to collapsible helmets including a number of segments hinged in a manner movable between an expanded operative position and a folded inoperative position.

Personnel engaged in occupations or activities with high levels of danger are required to wear headgear to protect the wearers' heads against impact. Such headgear typically provides one of two levels of protection depending on which parts of the wearers' head are to be protected. The first level of protection is provided by "half helmets" for protecting the crown of a wearer whereas the second level of protection is provided by "full helmets" for protecting both the crown and the face of the wearer.

Such headgear typically includes a rigid shell helmet with a flexible internal rigging for supporting the shell in spaced relation to the wearers' heads. Rigid shell helmets suffer from a number of disadvantages. First, that they are relatively heavy when worn. Second, that they are inconvenient to carry when not in use. And third, they are inconvenient to store when not in use.

A number of collapsible helmets have been suggested to overcome some of these disadvantages as now described hereinbelow:

- U.S. Pat. No. 3,987,495 to Holley describes a motorcycle helmet having two halves which may be detachably secured together for use or separated for easy storage. The halves come together at the central vertical plane that extends from the front of the helmet to the rear and thereby divides it into a right half and a left half that are mirror images of each other.
- U.S. Pat. No. 4,587,676 to Estadella describes a collapsible helmet including two supplemental portions which are mutually joined at two pivot points. The supplemental portions rotate about the rotating points and engage one inside the other in a folded position and engage along a line which extends parallel to a line which defines the bottom perimeter of the helmet.
- U.S. Pat. No. 4,827,537 to Villa describes a helmet having a plurality of segments which are interhinged for swinging movement between an expanded operating position and a collapsed non-operating position. The segments have cooperating ribs and recesses to maintain them in the expanded operating position.
- U.S. Pat. No. 4,091,470 to Ryunishin describes a collapsible helmet composed of several inwardly curved fan-shaped sections. The helmet can be folded into a nested position so as to assume the size of one of the sections.

Such developments suffer from a number of disadvantages including that they typically include a large number of elements and complicated mechanisms, they are cumbersome during conversion from their expanded operative positions to their folded inoperative positions and vice versa, and packages formed by the collapsible helmets are large and awkwardly shaped.

Therefore, there is a need for a collapsible helmet which overcomes the disadvantages of conventional collapsible helmets.

SUMMARY OF THE INVENTION

The present invention is for a number of implementations of collapsible helmets for protecting either the crown of a wearer or the crown and the face of a wearer.

Hence, there is provided according to the teachings of the present invention, a collapsible helmet comprising: (a) a substantially elliptic headband having a left side portion and a right side portion; and (b) an arc-shaped strap hingedly attached to the left side portion and the right side portion, the strap extending laterally across the crown of a wearer when deployed in its substantially upright operative position so as to define a head protecting shell and lying substantially co-planar with the headband when deployed in its folded inoperative position so as to define a compact package.

According to a further feature of the present invention, the strap is exterior to the headband.

According to a still further feature of the present invention, the strap is interior to the headband.

According to a yet still further feature of the present invention, the headband includes a forehead portion and a nape portion, the helmet further comprising a pair of arc-shaped ribs hingedly attached to the forehead portion and to the nape portion, the pair of ribs extending longitudinally across the crown of a wearer when deployed in their substantially upright operative positions and lying co-planar with the headband when deployed in their folded inoperative positions.

According to a yet still further feature of the present invention, the pair of ribs are interior to the headband.

According to a yet still further feature of the present invention, the pair of ribs are exterior to the headband.

According to a yet still further feature of the present invention, the helmet further comprising a stopper deployed either at the forehead portion or at the nape portion for stopping the ribs in a spaced apart arrangement one from the other when deployed in their the operative positions.

According to a yet still further feature of the present invention, the helmet further comprising an arc-shaped face guard hingedly attached to the headband, the face guard extending laterally across the chin of a wearer when deployed in its substantially downward inclined operative position so as to define a face protecting shield and lying co-planar with the headband when deployed in its folded inoperative position so as to substantially lie flush with the compact package.

According to a yet still further feature of the present invention, the face guard is exterior to the headband.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
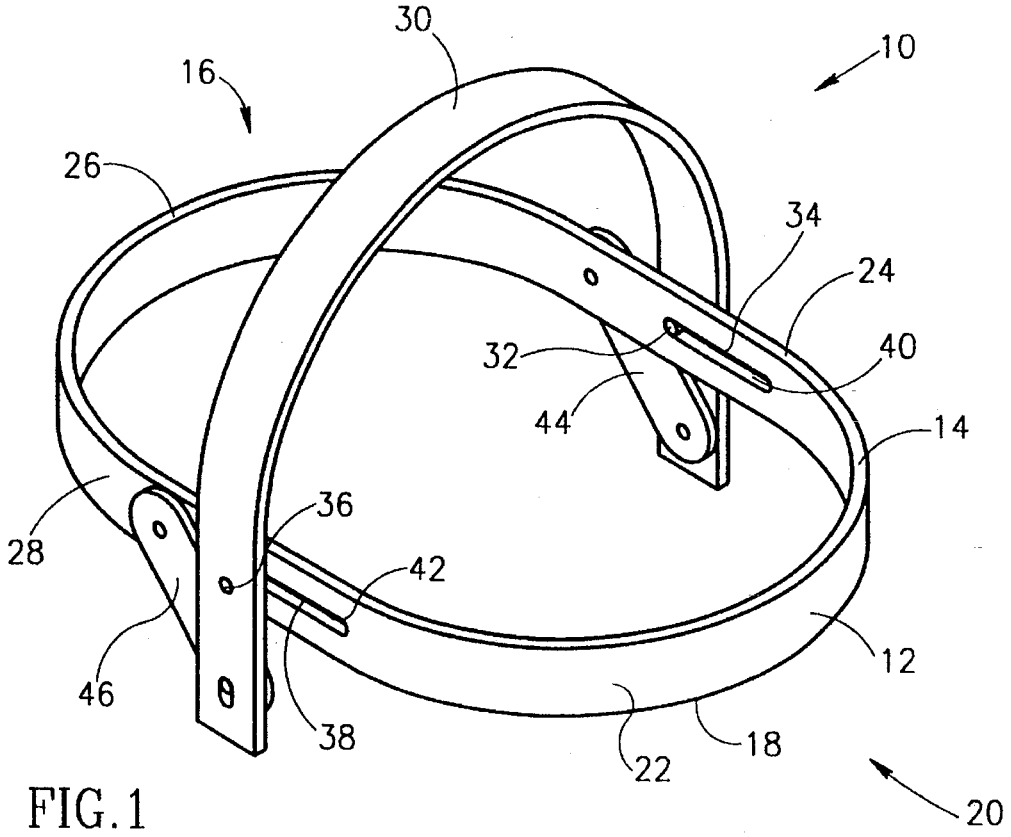
FIG. 1 shows a perspective view of a preferred embodiment of a helmet including a headband and an arc-shaped strap, constructed and operative according to the teachings of the present invention, deployed in its upright operative position.

The present invention is of a number of implementations of collapsible helmets for protecting either the crown of a wearer or the crown and the face of a wearer.

The principles and operation of the collapsible helmets of the present invention may be better understood with reference to the drawings and the accompanying description.

Broadly speaking, the collapsible helmets of the present invention are designed to provide protection to the head of a wearer by means of one or more relatively narrow segments having widths in the order of about 30 mm to about 50 mm. In particular, the collapsible helmets of the present invention include a headband and a rigid arc-shaped strap extending laterally across the crown of a wearer when deployed in its upright operative position and/or a pair of rigid arc-shaped ribs extending longitudinally across the crown of a wearer when deployed in their upright operative positions. Furthermore, the helmets can also include a face guard for protecting the chin of a wearer when deployed in its downward inclined operative position. It is a further feature of the present invention that the segments are hingedly attached to the headband such that they lie co-planar with the headband when deployed in their folded inoperative positions.

Thus, it can be readily appreciated that the collapsible helmets according to the teachings of the present invention provide protection against head on impacts and side on impacts. Therefore, it can also be readily appreciated that the collapsible helmets of the present invention provide, in effect, near to or the equivalent degree of protection as conventional continuous shell helmets notwithstanding that considerably less of the total area of the wearer's head is covered.

Referring now to the drawings, FIGS. 1–6 depict a collapsible helmet, generally designated 10, constructed and operative according to the teachings of the present invention. Collapsible helmet 10 is typically fabricated from aluminum, a durable composite material, plastic, or the like. Collapsible helmet 10 can be provided as a half-helmet for protecting the crown of a wearer or as a full helmet for protecting both the crown and the face of a wearer as will become apparent hereinbelow. It should be noted that FIGS. 1–6 only depict the skeleton of collapsible helmet 10 and that a fully made up collapsible helmet 10 includes a flexible outer coveting, a flexible internal rigging for supporting a helmet in a spaced relation relative to a wearer's head, fastening straps for tightening a helmet on a wearer's head, locking mechanisms for locking the helmet in its expanded operative position and its folded inoperative position, and the like.

Helmet 10 includes a substantially elliptic headband 12 having an upper rim 14 defining an upper plane, generally designated 16, and a lower rim 18 defining a lower plane, generally designated 20. For the sake of convenience, headband 12 is divided into four portions as follows: a forehead portion 22, a left side portion 24, a nape portion 26 and a fight side portion 28. The distance between forehead portion 22 and nape portion 26 defines the long axis of headband 12 whereas the distance between left side portion 24 and right side portion 28 defines the short axis of headband 12.

Rims 14 and 18 are generally parallel and therefore upper plane 16 and lower plane 20 are preferably parallel. However, it should be noted that rims 14 and 18 can include protrusions and recesses. Furthermore, rims 14 and 18 can be fabricated such that upper plane 16 and lower plane 20 have a slight forward or rearward convergence therebetween.

Helmet 10 also includes at least one rigid arc-shaped strap 30 which can be articulated relative to headband 12 to one of two positions: First, a substantially upright operative position in which strap 30 extends laterally across the crown of a wearer, thereby defining a head protecting shell, as shown in FIG. 1. And second, a folded inoperative position in which strap 30 lies co-planar with upper plane 16 and lower plane 20 defined by rims 14 and rims 18 of headband 12, thereby forming a compact package, as shown in FIG. 2.

In particular, arc-shaped strap 30 includes a left pin 32 hingedly attached to left side portion 24 at an attachment point 34 and a right pin 36 hingedly attached to right side portion 28 at an attachment point 38. Attachment points 34 and 38 are laterally arranged and preferably implemented as slots 40 and 42, respectively, such that strap 30 can be deployed at opposite ends of slots 40 and 42 to facilitate the conversion of helmet 10 from a head protecting shell to a relatively thin compact package. As shown, strap 30 is deployed toward nape portion 26 along slots 40 and 42 when deployed in its substantially upright operative position and is deployed toward forehead portion 22 when deployed in its folded inoperative position.

Helmet 10 preferably includes a pair of spring-biased locking links 44 and 46 adapted to maintain helmet 10 in either its substantially upright operative position or its folded inoperative position. Links 44 and 46 typically include pins reciprocating in slots provided in extensions to the left side and right side of arc-shaped strap 30, respectively.

Figure 2:
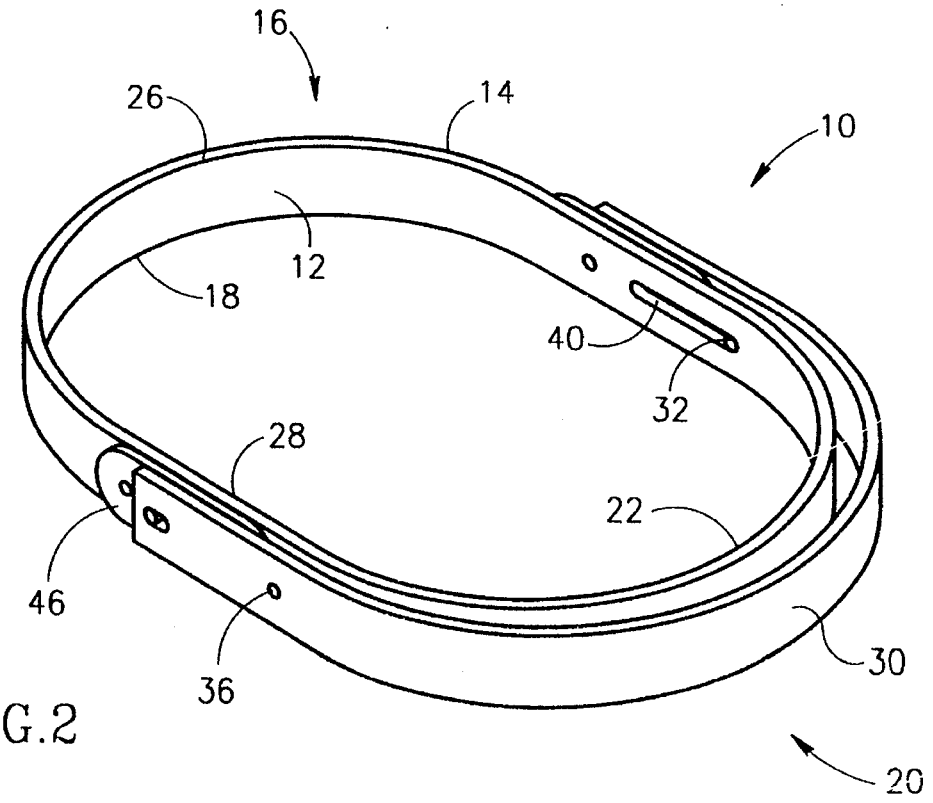
FIG. 2 shows a perspective view of the helmet of FIG. 1 in which the arc-shaped strap is deployed its folded inoperative position.

FIGS. 1 and 2 depict arc-shaped strap 30 as being exterior to headband 12, however, arc-shaped strap 30 can equally be interior to headband 12. In the case that arc-shaped strap 30 is exterior to headband 12, the curvature of strap 30 is less than the curvature of forehead portion 22 and the distance between the ends of arc-shaped strap 30 is greater than the short axis of headband 12.

Figure 3:
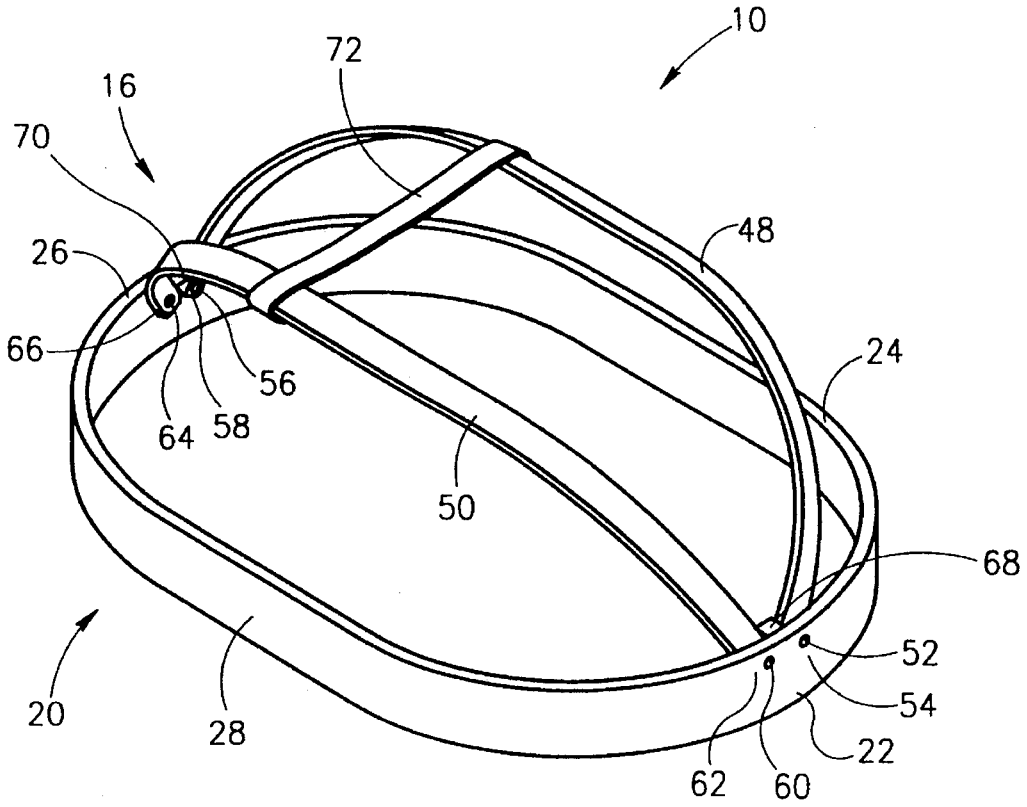
FIG. 3 shows a perspective view of a helmet including a pair of arc-shaped ribs deployed in their upright operative positions.
Figure 4:
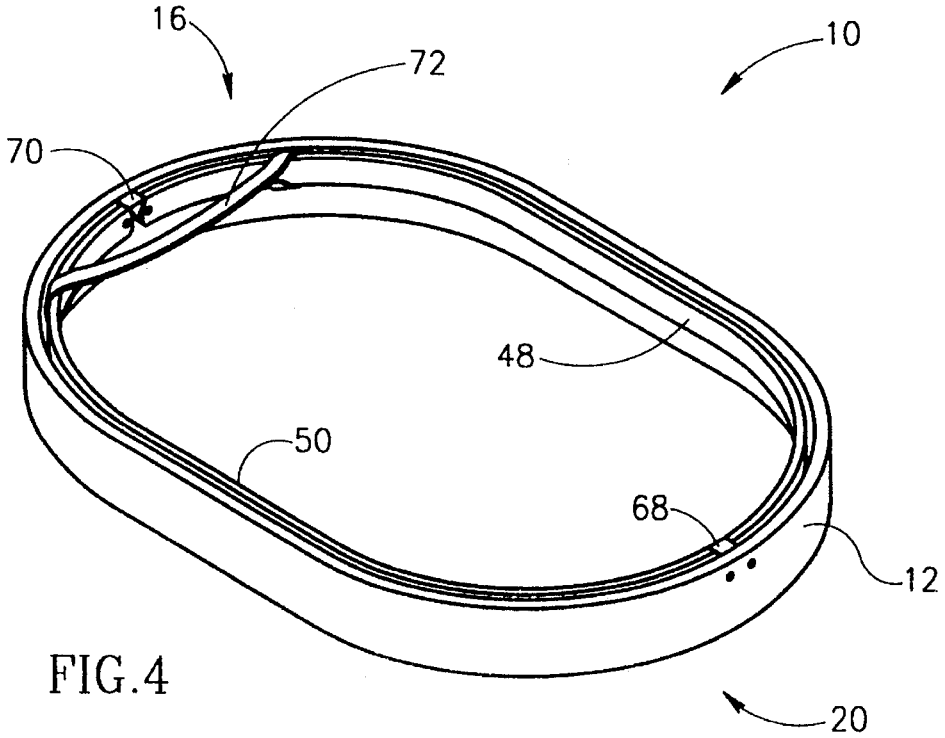
FIG. 4 shows a perspective view of the helmet of FIG. 3 in which the pair of arc-shaped ribs are deployed in their folded inoperative positions.

With reference now to FIGS. 3 and 4, as an alternative to or as a supplement to arc-shaped strap 30, helmet 10 can further include at least one pair of rigid arc-shaped ribs 48 and 50 which can be articulated relative to headband 12 to one of two positions: First, substantially upright operative positions in which ribs 48 and 50 extend longitudinally across the crown of a wearer, thereby defining a head protecting shell, as shown in FIG. 3. And second, folded inoperative positions in which ribs 48 and 50 lie co-planar with upper plane 16 and lower plane 20 defined by rims 14 and rims 18 of headband 12, thereby forming a relatively thin compact package, as shown in FIG. 4. In their substantially upright operative positions, arc-shaped rims 48 and 50 provide longitudinal rigidity against impacts.

In particular, arc-shaped rib 48 includes a front pin 52 hingedly attached to forehead portion 22 at an attachment point 54 and a rear pin 56 hingedly attached to nape portion 26 at an attachment point 58. In a similar fashion, arc-shaped rib 50 includes a front pin 60 hingedly attached to forehead portion 22 at an attachment point 62 and a rear pin 64 hingedly attached to nape portion 26 at an attachment point 66. Ribs 48 and 50 preferably have a spaced apart configuration relative to headband 12 in their substantially upright operative position which is achieved by means of a pair of stoppers 68 and 70 employed at forehead portion 22 and nape portion 26, respectively, and a sliding belt 72.

FIGS. 3 and 4 depict arc-shaped ribs 48 and 50 as being interior to headband 12, however, ribs 48 and 50 can equally be exterior to headband 12. In the case that arc-shaped ribs 48 and 50 are interior to headband 12, the curvature of ribs 48 and 50 is greater than the curvature of left side and right side portions 24 and 28 and the distance between the ends of arc-shaped ribs 48 and 50 is less than the long axis of headband 12.

It should be noted that when arc-shaped ribs 48 and 50 are used as a supplement to arc-shaped strap 30, they are typically employed in an opposite sense relative to arc-shaped strap 30. In other words, arc-shaped ribs 48 and 50 are interior to headband 12 when arc-shaped strap 30 is exterior thereto. And, conversely, arc-shaped ribs 48 and 50 are exterior to headband 12 when arc-shaped strap 30 is interior thereto.

Figure 5:
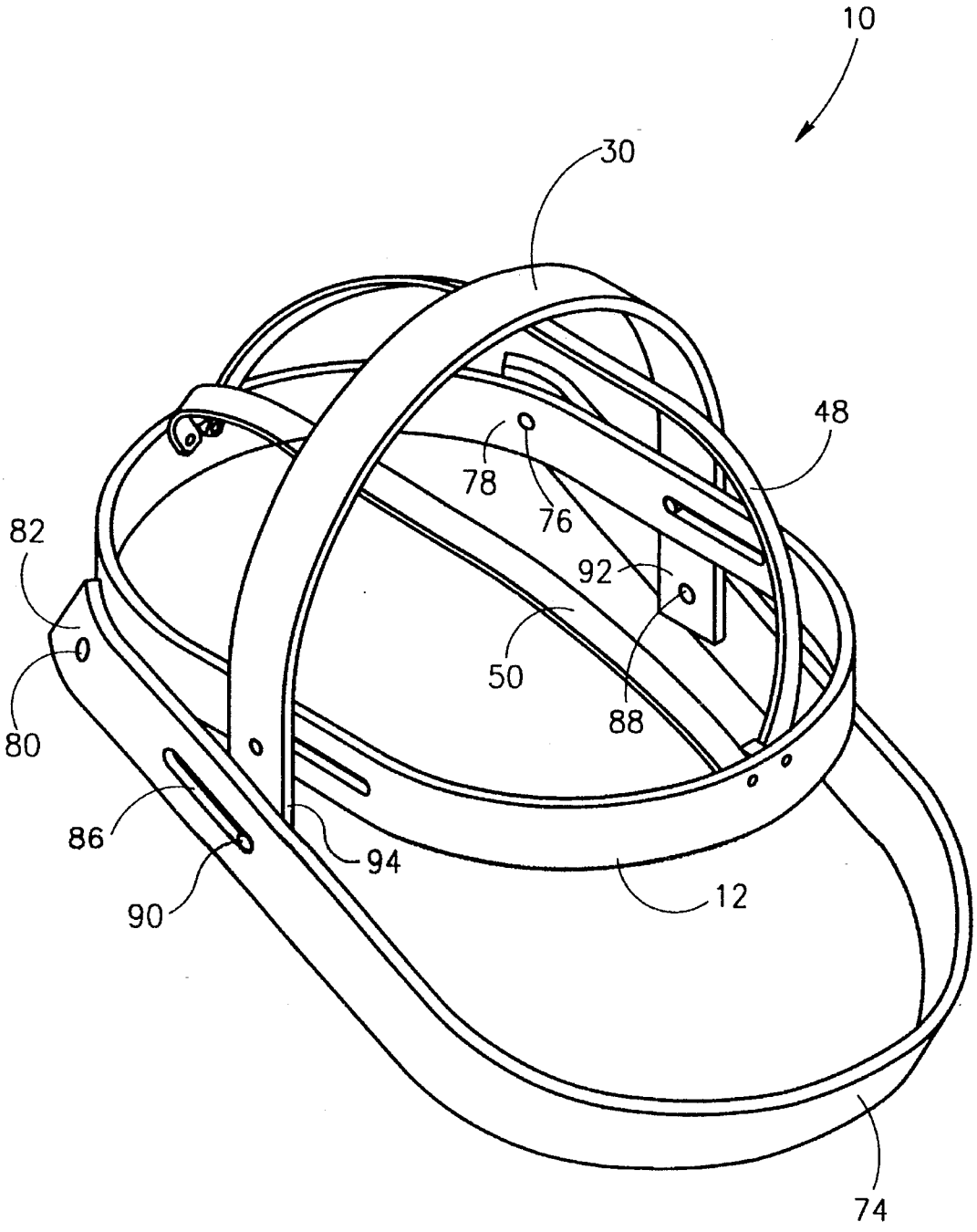
FIG. 5 shows a perspective view of the helmet of FIG. 3 including a face guard deployed in its downward inclined operative position.
Figure 6:
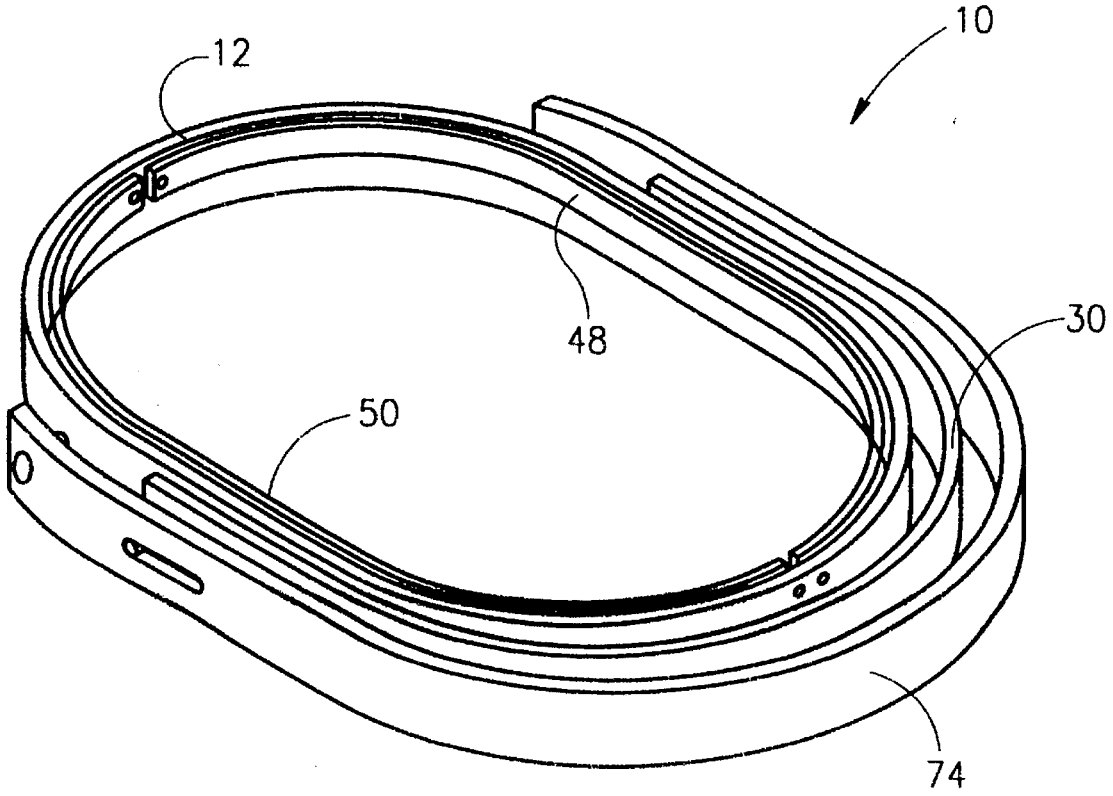
FIG. 6 shows a perspective view of the helmet of FIG. 5 in which the face-guard is deployed in its folded inoperative position.

With reference now to FIGS. 5 and 6, helmet 10 can further include an arc-shaped face guard 74 which can be articulated relative to headband 12 to one of two positions: First, a substantially downward inclined operative position in which face guard 74 extends laterally across the chin of a wearer, thereby defining a face protecting shield, as shown in FIG. 5. And second, a folded inoperative position in which face guard 74 lies co-planar with upper plane 16 and lower plane 20 defined by rims 14 and rims 18 of headband 12 so as to lie flush with the relatively thin compact package achieved by either strap 30 or fibs 48 and 40, as shown in FIG. 6.

In the present case, arc-shaped face guard 74 includes a left pin 76 hingedly attached to left side portion 24 at an attachment point 78 and a right pin 80 hingedly attached to fight side portion 28 at an attachment point 82. Furthermore, face guard 74 includes a pair of laterally arranged slots 84 (not shown) and 86, which are used to articulate face guard 74 relative to headband 12 by means of pins 88 and 90, respectively, provided on extensions 92 and 94, respectively, to strap 30. Hence, pins 88 and 90 reciprocate between the front ends of slots 84 and 86 and the rear ends of slots 84 and 86 in the following manner. First, when face guard 74 is deployed into its substantially downward inclined operative position, pins 88 and 90 urge strap 30 into its upright operative position. And second, when face guard 74 is deployed into its folded inoperative position, pins 88 and 90 urge strap 30 into its folded inoperative position.

As a space saving measure, it should be noted that helmet 10 can be configured such that strap 30 lies to the rear of headband 12 and face guard 74 lies to the front of headband 12 when deployed in their folded inoperative positions.

All in all, it can be readily appreciated that the collapsible helmet of the present invention has several important advantages over the collapsible helmets described in the prior art. First, the collapsible helmet is more rigid than most conventional collapsible helmets. Second, the collapsible helmet includes far less elements and does not require any complicated mechanism. Third, the helmet can be readily converted from its expanded operative position to its folded inoperative position and vice versa. And fourth, the compact package formed by the helmet in its folded inoperative state is generally smaller than the packages formed by prior art collapsible helmets and has a regular relatively thin elliptic shape rather than some awkward shaped package formed by prior art collapsible helmets.

While the invention has been described with respect to a limited number of embodiments, it will be appreciated that many variations, modifications and other applications of the invention may be made.

What is claimed is:

1. A collapsible helmet comprising:

(a) a substantially elliptic rigid headband having a left side portion and a right side portion, said headband including a forehead portion and a nape portion;

(b) a rigid arc-shaped strap hingedly attached to said left side portion and said right side portion, said strap extending laterally across the crown of a wearer when deployed in its substantially upright operative position so as to define a head protecting shell and lying substantially co-planar with said headband when deployed in its folded inoperative position so as to define a compact package; and (c) a pair of rigid arc-shaped ribs hingedly attached to said forehead portion and to said nape portion, said pair of ribs extending longitudinally across the crown of a wearer when deployed in their substantially upright operative positions and lying co-planar with said headband when deployed in their folded inoperative positions.

2. The helmet as in claim 1 wherein said strap is exterior to said headband.

3. The helmet as in claim 1 wherein said strap is interior to said headband.

4. The helmet as in claim 1 wherein said pair of ribs are interior to said headband.

5. The helmet as in claim 1 wherein said pair of ribs are exterior to said headband.

6. The helmet as in claim 1 further comprising a stopper deployed either at said forehead portion or at said nape portion for stopping said ribs in a spaced apart arrangement one from the other when deployed in their said operative positions.

7. The helmet as in claim 1 further comprising an arc-shaped face guard hingedly attached to said headband, said face guard extending laterally across the chin of a wearer when deployed in its substantially downward inclined operative position so as to define a face protecting shield and lying co-planar with said headband when deployed in its folded inoperative position so as to substantially lie flush with said compact package.

8. The helmet as in claim 7 wherein said face guard is exterior to said headband.

9. A collapsible helmet comprising:

(a) a substantially elliptic rigid headband having a forehead portion and a nape portion; and (b) a pair of rigid arc-shaped ribs hingedly attached to said forehead portion and to said nape portion, said pair of ribs extending longitudinally across the crown of a wearer when deployed in their substantially upright operative positions so as to define a head protecting shell and lying co-planar with said headband when deployed in their folded inoperative positions so as to define a compact package.

10. The helmet as in claim 9 further comprising a stopper deployed either at said forehead portion or at said nape portion for stopping said ribs in a spaced apart arrangement one from the other when deployed in their said substantially upright operative positions.

11. The helmet as in claim 9 wherein said headband includes a left side portion and a right side portion and the helmet further comprises an arc-shaped strap hingedly attached to said left side portion and said right side portion, said strap extending laterally across the crown of a wearer when deployed in its substantially upright operative position and lying coplanar with said headband when deployed in its folded inoperative position.

12. The helmet as in claim 11 wherein said strap is exterior to said headband.

13. The helmet as in claim 11 wherein said strap is interior to said headband.

14. The helmet as in claim 9 further comprising an arc-shaped face guard hingedly attached to said headband, said face guard extending laterally across the chin of a wearer when deployed in its substantially downward inclined operative position so as to define a face protecting shield and lying co-planar with said headband when deployed in its folded inoperative position so as to lie flush with said compact package.

15. The helmet as in claim 14 wherein said face guard is exterior to said headband.

16. The helmet as in claim 9 wherein said pair of ribs are interior to said headband.

17. The helmet as in claim 9 wherein said pair of ribs are exterior to said headband.

* * * * *